US007266928B1

(12) United States Patent
Stasiak, Jr.

(10) Patent No.: US 7,266,928 B1
(45) Date of Patent: Sep. 11, 2007

(54) GOLF BALL DEFLECTING WINDOW COVER

(76) Inventor: James A. Stasiak, Jr., 14070 Rogers La., Victorville, CA (US) 92392

( * ) Notice: Subject to any disclaimer, the term of this patent is extended or adjusted under 35 U.S.C. 154(b) by 323 days.

(21) Appl. No.: 10/884,272

(22) Filed: Jul. 6, 2004

(51) Int. Cl.
*E06B 3/26* (2006.01)

(52) U.S. Cl. ..... 52/202; 49/56; 49/67

(58) Field of Classification Search ..... 49/50, 49/56, 67, 61, 62, 63, 463; 52/202
See application file for complete search history.

(56) References Cited

U.S. PATENT DOCUMENTS 2,093,727 A * 9/1937 Julien ..... 49/62
2,221,005 A 11/1940 Reese
2,308,918 A 1/1943 Hertel et al.
2,925,862 A 2/1960 Sundby
3,116,519 A * 1/1964 Keith ..... 49/56
3,991,806 A 11/1976 Abell
4,055,360 A * 10/1977 Russi ..... 292/228
4,126,965 A * 11/1978 Hoffmann ..... 49/398
4,255,901 A * 3/1981 Stenberg ..... 49/402
4,320,609 A 3/1982 Abell
4,368,594 A * 1/1983 Milam et al. ..... 49/67
4,566,222 A * 1/1986 Hatvany ..... 49/56
5,228,238 A * 7/1993 Fenkell ..... 49/63
5,832,666 A * 11/1998 Flack et al. ..... 49/67
6,047,500 A 4/2000 Caplette
6,691,468 B2 * 2/2004 Helferty ..... 49/463

* cited by examiner

*Primary Examiner*—Gregory J. Strimbu

(57) ABSTRACT

A golf ball deflecting window cover includes a window frame and a window that is mounted therein. A panel of transparent plastic material has a first side, a second side, a top edge, a bottom edge, a first side edge and a second side edge. At least one hinge member hingedly couples the first side of the panel to the window frame. The panel is positionable in a closed position positioned in front of the window or in an open position extending away from the window. At least one latching assembly is adapted for selectively locking the panel in the closed position.

7 Claims, 4 Drawing Sheets

GOLF BALL DEFLECTING WINDOW COVER

BACKGROUND OF THE INVENTION

1. Field of the Invention

The present invention relates to deflection devices and more particularly pertains to a new deflection device for preventing a golf ball from striking and breaking a window.

2. Description of the Prior Art

The use of deflection and shield devices is known in the prior art. U.S. Pat. No. 2,221,005 describes a device for forming a shield over a window to create an enclosed air pocket between the shield the and the window for insulation purposes. Another type of deflection device is U.S. Pat. No. 6,047,500 that includes a bracket mounted to a window frame, or adjacent to a window, which is then adapted for holding a shield adjacent to the window. A storm window construction utilizing a shield mounted on a bracket is shown in U.S. Pat. No. 3,991,806.

While these devices fulfill their respective, particular objectives and requirements, the need remains for a device that is particularly adapted for deflecting a golf ball so that it does not strike, and thereby break, a window. Such a device should be attached to a window frame so that it is spaced from the window and it should includes flanges for deflecting rain and golf balls. Additionally, the device should be hingedly coupled to the window so that it may be opened during an emergency situation.

SUMMARY OF THE INVENTION

The present invention meets the needs presented above by generally comprising a window frame and a window that is mounted therein. A panel of transparent plastic material has a first side, a second side, a top edge, a bottom edge, a first side edge and a second side edge. At least one hinge member hingedly couples the first side of the panel to the window frame. The panel may be positionable in a closed position positioned in front of the window or in an open position extending away from the window. At least one latching assembly is adapted for selectively locking the panel in the closed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
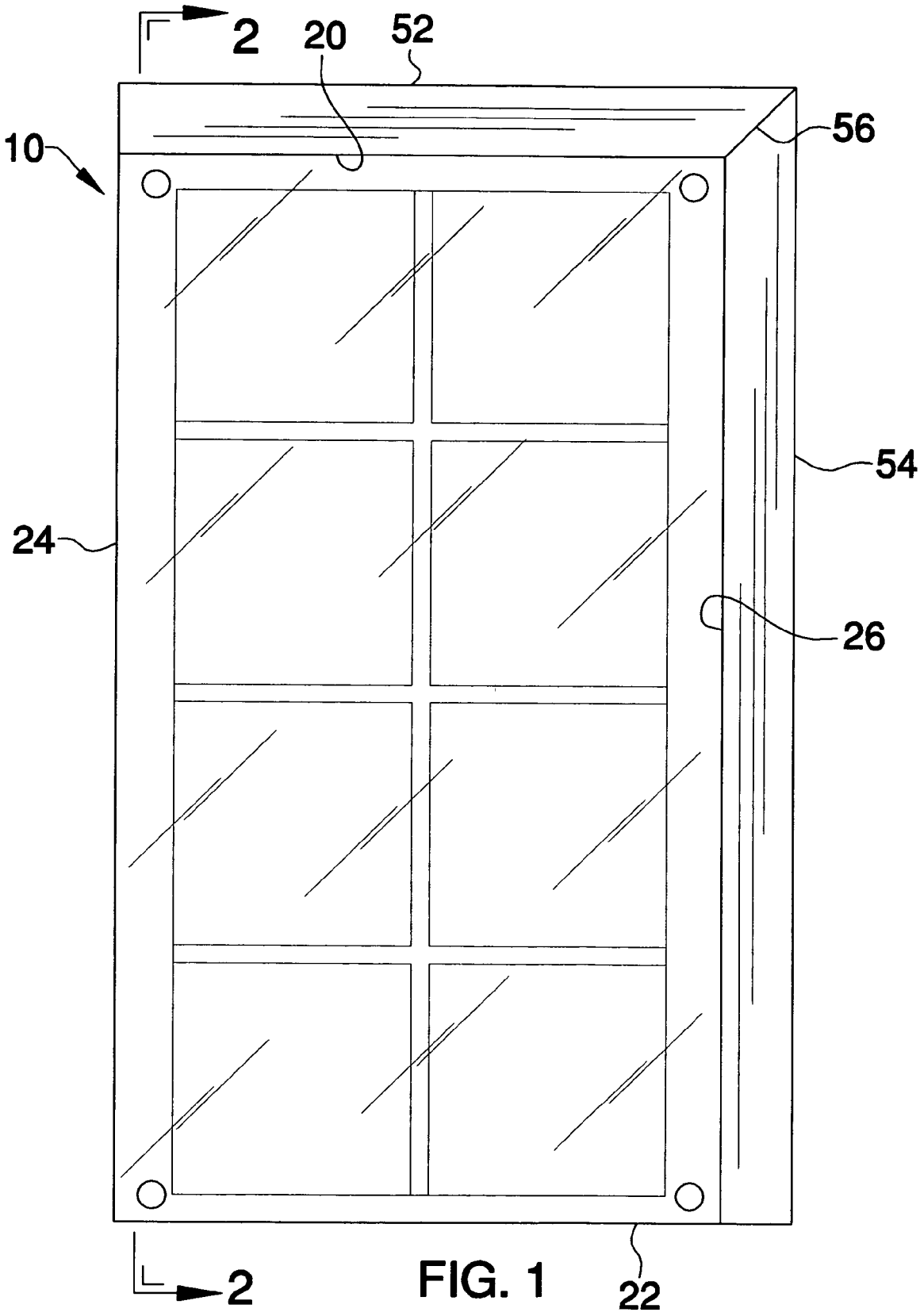
FIG. 1 is a front view of a golf ball deflecting window cover according to the present invention.
Figure 2:
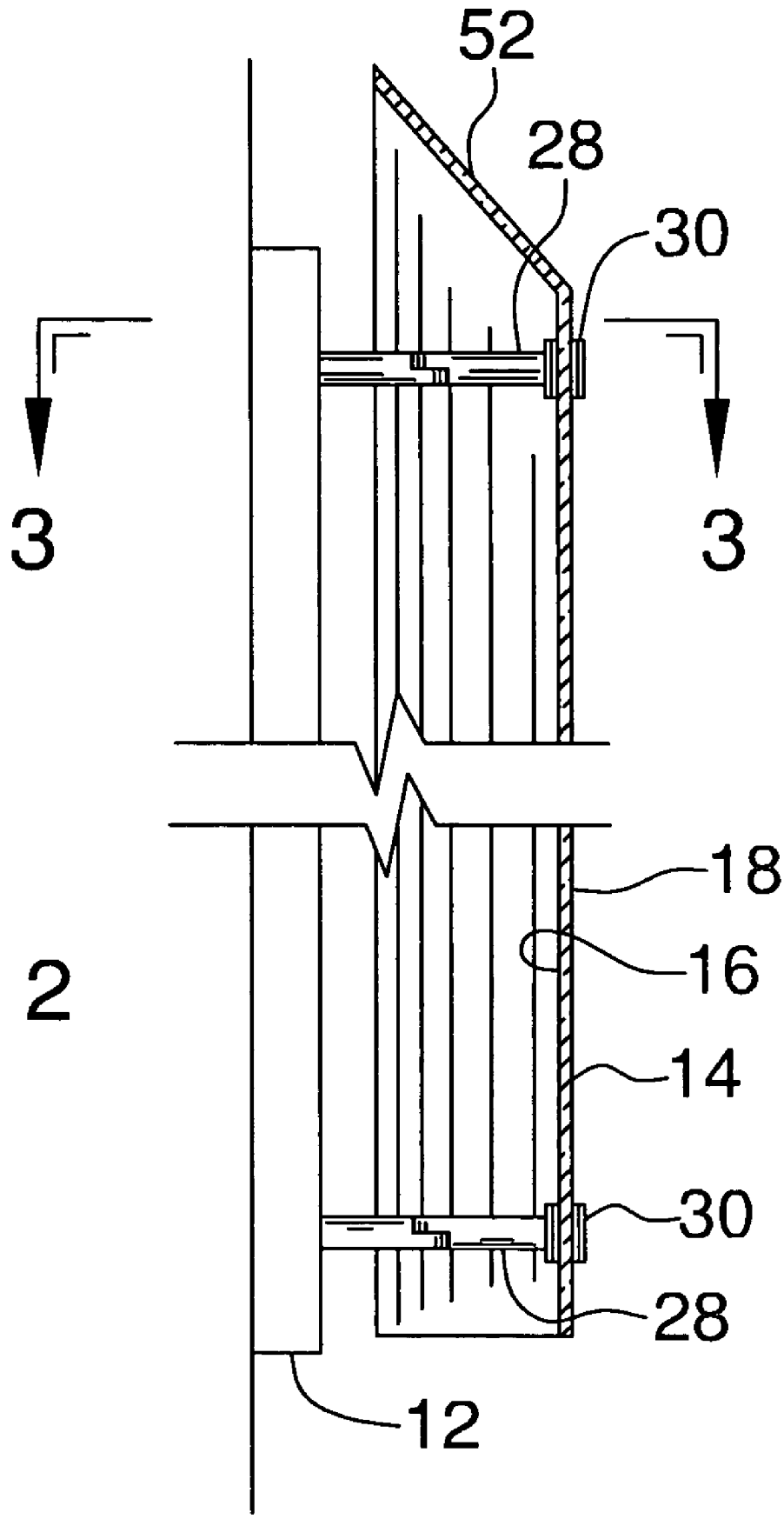
FIG. 2 is a cross-sectional view taken along line 2-2 of FIG. 1 of the present invention.
Figure 3:
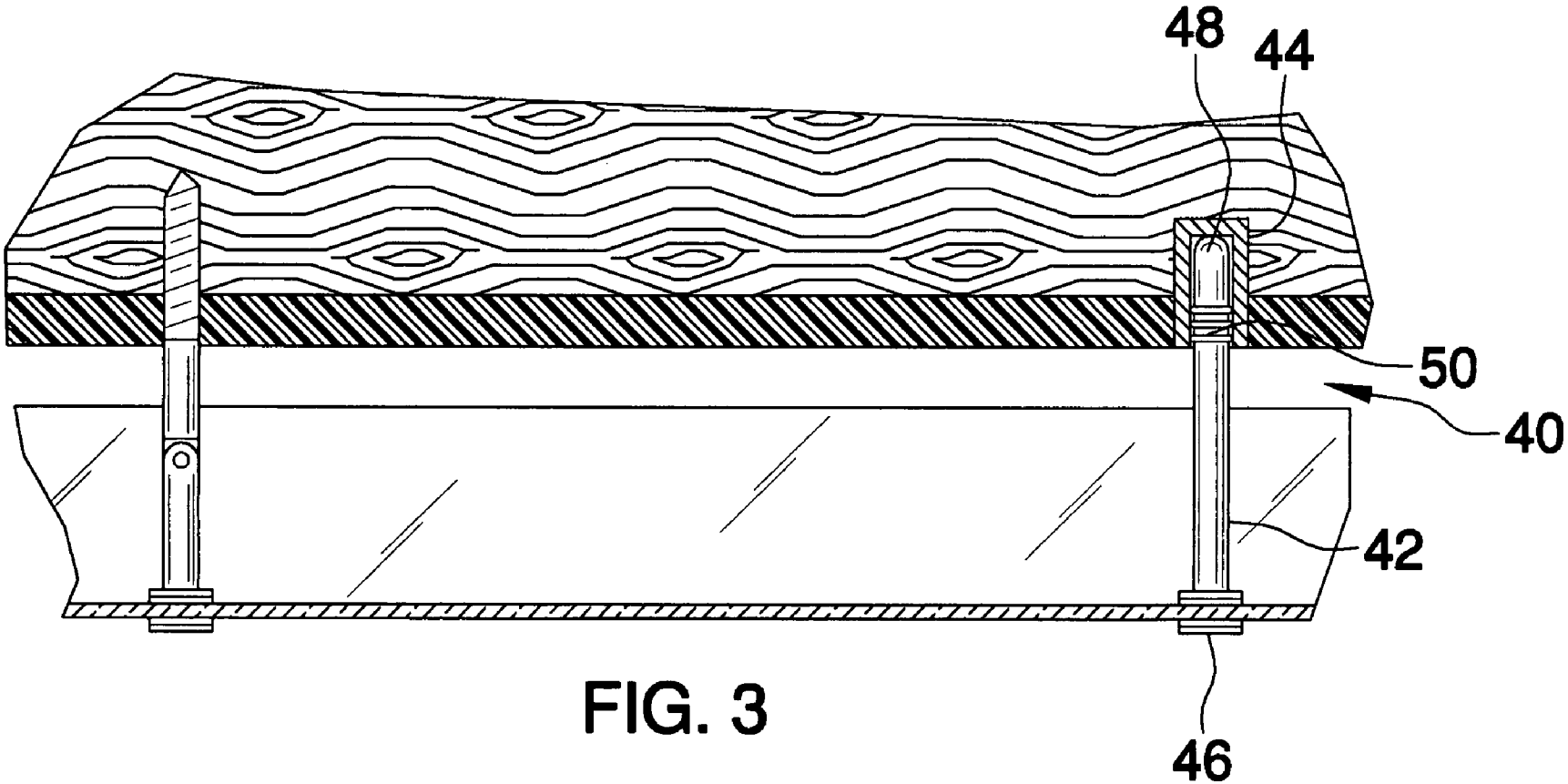
FIG. 3 is a cross-sectional view taken along line 3-3 of FIG. 2 of the present invention.
Figure 4:
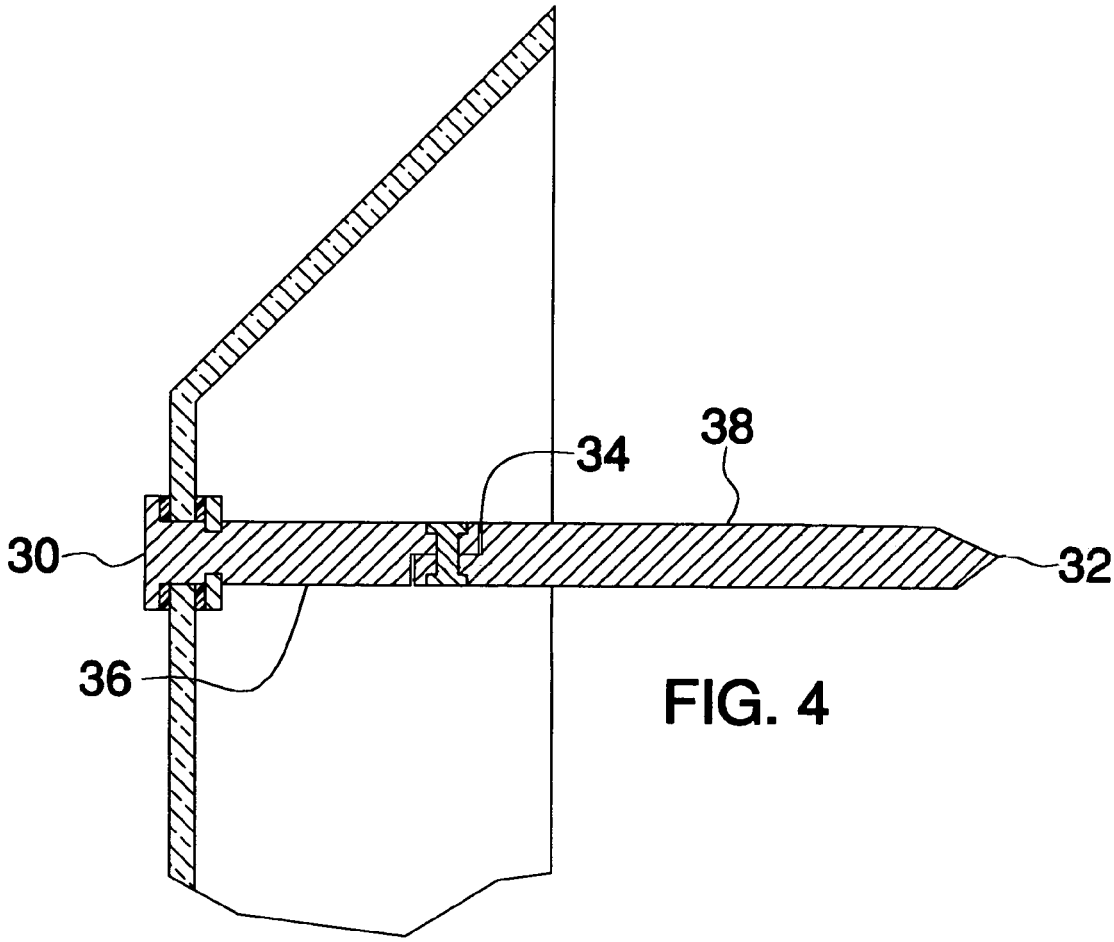
FIG. 4 is a cross-sectional view of a hinge of the present invention.
Figure 5:
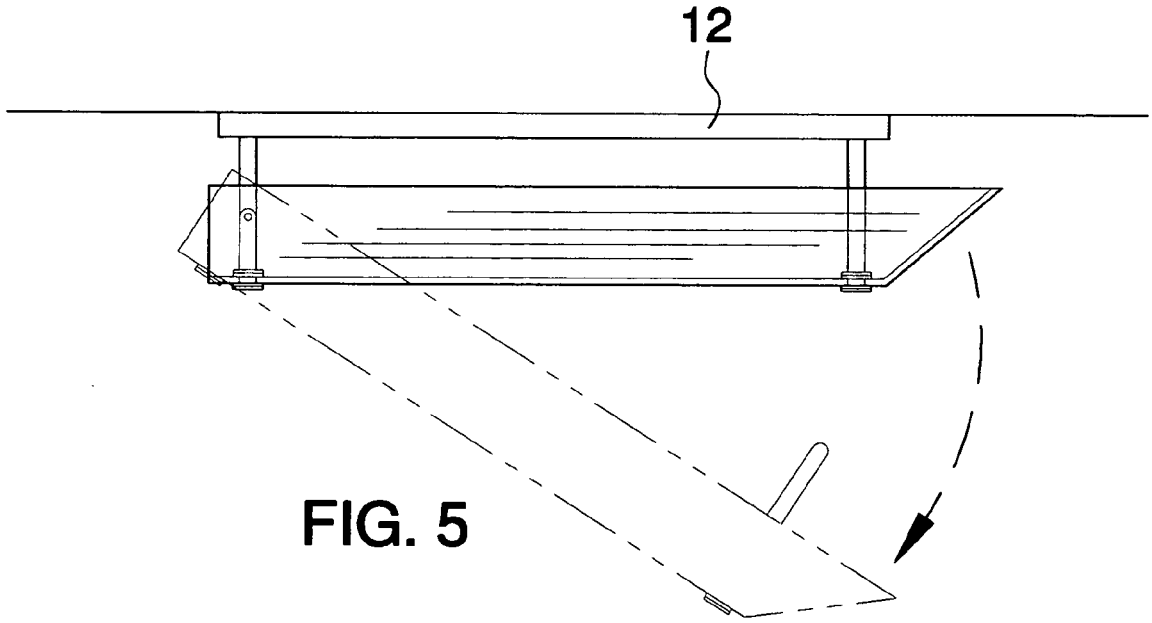
FIG. 5 is a top view of the present invention.

With reference now to the drawings, and in particular to FIGS. 1 through 5 thereof, a new deflection device embodying the principles and concepts of the present invention and generally designated by the reference numeral 10 will be described.

As best illustrated in FIGS. 1 through 5, the golf ball deflecting window cover 10 generally comprises a conventional window frame 12 having a conventional window mounted therein. A panel 14 is provided that is comprised of a substantially transparent plastic material. The panel 14 has a first side 16, a second side 18, a top edge 20, a bottom edge 22, a first side edge 24 and a second side edge 26.

At least one, and preferably a pair of hinge members 28 are provided. Each of the hinge members 28 hingedly couples the first side 16 of the panel 14 to the window frame 12. Each of the hinge members 28 is positioned adjacent to the first edge 24 and are vertically aligned with each other. Each of the hinge members 28 is elongated and has a first end 30 and a second end 32. The first ends 30 are attached to the panel 14 such that each of the hinge members 30 extends away from the first side 16 of the panel 14. The hinge members 30 each have a break 34 therein such that a first portion 36 and a second portion 38 of the hinge members 30 are defined. Each of the first portions 36 is hingedly coupled to a corresponding one of the second portions 38. The second ends 32 are each attached to the window frame 12 such that the panel 14 may be positioned in a closed position positioned in front of the window or in an open position extending away from the window.

At least one latching assembly 40 is adapted for selectively locking the panel 14 in the closed position. The at least one latching assembly 40 includes a rod 42 and a female coupler 44. The rod 42 has proximal end 46 attached to the panel 14 and is positioned adjacent to the second edge 26. The female coupler 44 is mounted in the frame 12 and is positioned for selectively mating with a distal end 48 of the rod 42 when the panel 14 is positioned in the closed position. Rubber grommets 50 may be attached to and extended around the rod 42 to aid in retaining the rod 42 within the female coupler. If two latching assemblies 40 are utilized, it is preferred that they are vertically aligned with each other and each is horizontally aligned with one of the hinge members 30.

An upper flange 52 is integrally attached to and extends along the top edge 20 of the panel 14. The upper flange 52 is angled with respect to the panel 14. An angle formed by the first side 16 and the upper flange 52 is generally between 95 degrees and 175 degrees. The upper flange 52 comprises a substantially transparent plastic material.

A side flange 54 is integrally attached to and extends along the second side edge 26 of the panel 14. The side flange 54 is angled with respect to the panel 14. An angle formed by the first side 14 and the side flange 54 is generally between 95 degrees and 175 degrees. The side flange 54 comprises a substantially transparent plastic material. The side 54 and upper 52 flanges may be joined along a diagonal 56.

In use, the panel 14 is attached to a window frame 12 so that that the side flange 54 is directed toward a direction from which a golf ball is most likely to come. The panel 14 protects the window from being struck by a golf ball while the side flange 54 prevents the golf ball from flying between the panel 14 and the window. The plastic material, while preventing the golf ball from breaking the glass, still allows a person to see out of the window. The upper flange 52 prevents rain from falling between the panel 14 and the window to ensure that it is shed down the outside of the panel 14.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf ball deflection system comprising:

a window frame mounted in a wall of a dwelling and a window being mounted in said window frame;

a panel comprised of a transparent plastic material, said panel having a first side, a second side, a top edge, a bottom edge, a first side edge and a second side edge;

at least one hinge member hingedly coupling said first side of said panel to the window frame, said panel being positionable in a closed position positioned in front of the window or in an open position extending away from the window;

at least one latching assembly being adapted for selectively locking said panel in said closed position;

an upper flange being integrally attached to and extending along said top edge of said panel, said upper flange being angled with respect to said panel, an angle formed by said first side and said upper flange being between 95 degrees and 175 degrees, said upper flange extending from said panel and toward said wall when said panel is in said closed position;

a side flange being integrally attached to and extending along said second side edge of said panel, said side flange being angled with respect to said panel, an angle formed by said first side and said side flange being between 95 degrees and 175 degrees, said side flange extending from said panel and toward said wall when said panel is in said closed position; and wherein both said first side edge and said bottom edge of said panel being free of a flange.

2. The system of claim 1, wherein said at least one hinge member is elongated and has a first end and a second end, said first end being attached to said panel such that said hinge member extends away from said first side of said panel, said hinge member having a break therein such that a first portion and a second portion of said hinge member are defined, said first portion being hingedly coupled to said second portion, said second end being attached to said window frame.

3. The system according to claim 2, wherein said at least one latching assembly includes a rod and a female coupler, said rod having a proximal end attached to said panel and being positioned adjacent to said second edge, said female coupler being mounted in said frame and being positioned for selectively mating with a distal end of said rod when said panel is positioned in said closed position.

4. The system according to claim 1, wherein said at least one latching assembly includes a rod and a female coupler, said rod having a proximal end attached to said panel and being positioned adjacent to said second edge, said female coupler being mounted in said frame and being positioned for selectively mating with a distal end of said rod when said panel is positioned in said closed position.

5. The system according to claim 1, wherein said upper flange comprises said transparent plastic material.

6. The system according to claim 1, wherein said side flange comprises said transparent plastic material.

7. A golf ball deflection system said comprising:

a window frame mounted in a wall of a dwelling and a window being mounted in said window frame;

a panel comprised of a transparent plastic material, said panel having a first side, a second side, a top edge, a bottom edge, a first side edge and a second side edge;

a pair of hinge members, each of said hinge members hingedly coupling said first side of said panel to the window frame, each of said hinge members being positioned adjacent to said first edge and being vertically aligned with each other, each of said hinge members being elongated and having a first end and a second end, each of said first ends being attached to said first side of said panel such that each of said hinge members extends away from said first side of said panel, each of said hinge members having a break therein such that a first portion and a second portion of each of said hinge members are defined, each of said first portions being hingedly coupled to a corresponding one of said second portions, each of said second ends being attached to said window frame such that said panel is positionable in a closed position positioned in front of the window or in an open position extending away from the window;

at least one latching assembly being adapted for selectively locking said panel in said closed position, said at least one latching assembly including a rod and a female coupler, said rod having proximal end attached to said panel and being positioned adjacent to said second edge, said female coupler being mounted in said frame and being positioned for selectively mating with a distal end of said rod when said panel is positioned in said closed position;

an upper flange being integrally attached to and extending along said top edge of said panel, said upper flange being angled with respect to said panel, an angle formed by said first side and said upper flange being between 95 degrees and 175 degrees, said upper flange comprising said transparent plastic material; and a side flange being integrally attached to and extending along said second side edge of said panel, said side flange being angled with respect to said panel, an angle formed by said first side and said side flange being between 95 degrees and 175 degrees, said side flange comprising said transparent plastic material, each of said upper and side flanges extending from said panel and toward said wall when said panel is in said closed position, each of said upper and side flanges being spaced from said wall when said panel is in said closed position, and both said first side edge and said bottom edge of said panel being free of a flange.

* * * * *